US007677178B2

(12) United States Patent
Ellmann et al.

(10) Patent No.: US 7,677,178 B2
(45) Date of Patent: Mar. 16, 2010

(54) DEVICE FOR CONTROLLING A PLATFORM DOOR LOCATED ON THE GUIDEWAY OF A TRACK-BOUND VEHICLE

(75) Inventors: Siegfried Ellmann, Aschheim (DE); Friedrich Loeser, Riemerling (DE)

(73) Assignee: ThyssenKrupp Transrapid GmbH, Kassel (DE)

( * ) Notice: Subject to any disclaimer, the term of this patent is extended or adjusted under 35 U.S.C. 154(b) by 134 days.

(21) Appl. No.: 11/547,925

(22) PCT Filed: Apr. 6, 2005

(86) PCT No.: PCT/DE2005/000605

§ 371 (c)(1),
(2), (4) Date: Oct. 5, 2006

(87) PCT Pub. No.: WO2005/100116

PCT Pub. Date: Oct. 27, 2005

(65) Prior Publication Data

US 2008/0190027 A1 Aug. 14, 2008

(51) Int. Cl.
*B61B 1/00* (2006.01)

(52) U.S. Cl. ..... 104/28; 104/27

(58) Field of Classification Search ..... 104/27, 104/28, 30; 49/31
See application file for complete search history.

(56) References Cited

U.S. PATENT DOCUMENTS 4,551,944 A * 11/1985 Donaldson ..... 49/31
4,843,968 A * 7/1989 Rikli ..... 104/27
4,988,061 A * 1/1991 Miller et al. ..... 246/182 R
5,053,654 A * 10/1991 Augsburger et al. ..... 310/12
5,176,082 A * 1/1993 Chun et al. ..... 104/28
5,422,552 A * 6/1995 Parisi ..... 318/466
5,594,316 A * 1/1997 Hayashida ..... 49/31
5,770,935 A * 6/1998 Smith et al. ..... 318/480
6,037,727 A * 3/2000 Kawanobe et al. ..... 318/286
6,341,563 B1 * 1/2002 Gal et al. ..... 104/28
2001/0022049 A1 * 9/2001 Clark et al. ..... 49/360
2002/0134275 A1 * 9/2002 Stiles ..... 104/27
2003/0093951 A1 * 5/2003 Ikeuchi ..... 49/31
2005/0022451 A1 * 2/2005 Fitzgibbon et al. ..... 49/31
2007/0251406 A1 * 11/2007 Brandt ..... 104/27
2008/0022596 A1 * 1/2008 Boerger et al. ..... 49/31
2008/0119964 A1 * 5/2008 Hoermann ..... 700/302
2008/0184623 A1 * 8/2008 Heigl et al. ..... 49/31
2008/0190027 A1 * 8/2008 Ellmann et al. ..... 49/31

FOREIGN PATENT DOCUMENTS

CA 2 325 044 5/2002
DE 33 03 961 8/1883
DE 38 07 919 9/1989
DE 39 17 058 11/1990
DE 196 25 193 12/1997

* cited by examiner

*Primary Examiner*—S. Joseph Morano
*Assistant Examiner*—Jason C Smith
(74) *Attorney, Agent, or Firm*—Michael J. Striker

(57) ABSTRACT

A device for controlling a platform door (14) located at the guideway (1) of a vehicle (2) is described. According to the invention, the device comprises, a sensor unit (17), which is mounted at the guideway (1) and which serves to detect a preselected state of the vehicle (2). An evaluating device (18) connected to the sensor unit (17) permits an opening of the platform door (14) only when the vehicle (2) is in the preselected state.

12 Claims, 2 Drawing Sheets

DEVICE FOR CONTROLLING A PLATFORM DOOR LOCATED ON THE GUIDEWAY OF A TRACK-BOUND VEHICLE

CROSS-REFERENCE TO RELATED APPLICATION

The invention described and claimed hereinbelow is also described in German Patent Application DE 10 2004 025 514.8 filed on Apr. 13, 2004. This German Patent Application provides the basis for a claim of priority of invention under 35 U.S.C. 119(a)-(d).

BACKGROUND OF THE INVENTION

The present invention relates to a device for controlling a platform door located on the guideway of a track-bound vehicle.

Track-bound and automatically controlled vehicle systems are frequently operated on guideways that are supported on vertical beams a few meters above ground. In the area of railway stations, it is therefore necessary to provide platforms which are arranged at an appropriate level. The danger thus caused is that travelers coming too close to the platform edge may fall down and suffer injuries. It is therefore known to configure the platforms as systems closed towards the outside and to provide a platform door at those places where a vehicle door is located when a vehicle stops in the railway station. The purpose is to restrict passenger transfer between vehicle and platform to a system composed of double doors. However the prerequisite to be fulfilled is that the vehicle doors and platform doors may only be unlocked and opened either if a vehicle door and a platform door stand immediately opposite to each other or if the opening procedure ends up with the result that a closed protection wall of the platform stands opposite to an open vehicle door or if a closed outer wall of the vehicle stands opposite to an open platform door. Those cases must, however, be avoided in which an open vehicle door is not within the area of a protection wall of the platform or in which an open platform door does not stand opposite to an outer wall of the vehicle.

In known magnetic levitation railways which are run in a driverless mode, the control of the vehicles is performed from a stationary operation center by means of a fully-automatically working operations management technology. Status and control signals from and to the vehicle are mostly transmitted in a wireless mode. Therefore, it would in principle be conceivable also to control the platform doors in the wireless mode from the operation center and to release unlocking of the platform doors only when the vehicle has taken a precisely fixed nominal position after its stoppage in a railway station.

Such a control of platform doors would not be free of deficiencies. To begin with, it is remarkable that a release for opening the platform doors should be granted at the earliest after the operation center has verified that the vehicle is in the desired nominal position. For this purpose it is required to determine the vehicle location by the aid of information data carriers mounted at the guideway and by the aid of data acquisition units accommodated inside the vehicle, further to transmit the determined location signals to the operation center and then to compare the prescribed nominal position with the transmitted location signals in a travel computer of the operation center. If it has safely been ascertained that the vehicle has reached the nominal position and is on standstill, this status must again be communicated from the travel computer to the operation center, whereupon the operation center after a thorough examination can ultimately grant a release for the platform doors. This procedure produces delays in time due to run-times and times for processing the signals. Another disadvantage is that the release signals produced upon a positive outcome of the examination are fed in the wireless mode to a receiver located within the relevant railway station and from there transmitted to the door opening and/or closing mechanisms which would involve quite a substantial expenditure of cost. This will be the case especially if high redundancy and, hence, safety are demanded and if the necessary cost for a safety computer as well as the provision and safety check of the relevant software are taken in to account.

SUMMARY OF THE INVENTION

Now, therefore, the technical problem to be solved by the present invention is to configure the device of the species mentioned above in such a manner that it can be produced in a simple and safe manner and that it does not require any transmission of signals in a wireless mode.

The invention yields the advantage that a release for door opening is made dependent only on the position of the vehicle in relation to the platform door. Hence, the door control is independent of a remote operation center. A long way round of measuring and control signals via an operation center is not necessary. Moreover, a device according to the present invention is simple, can be realized with a few construction elements and is therefore, safe and reliable in operation.

Other advantageous features of the present invention become evident from the subclaims.

The invention is explained in greater detail as set forth below by way of an embodiment and based on the drawings enclosed hereto, wherein:

DESCRIPTION OF THE PREFERRED EMBODIMENTS

Figure 1:
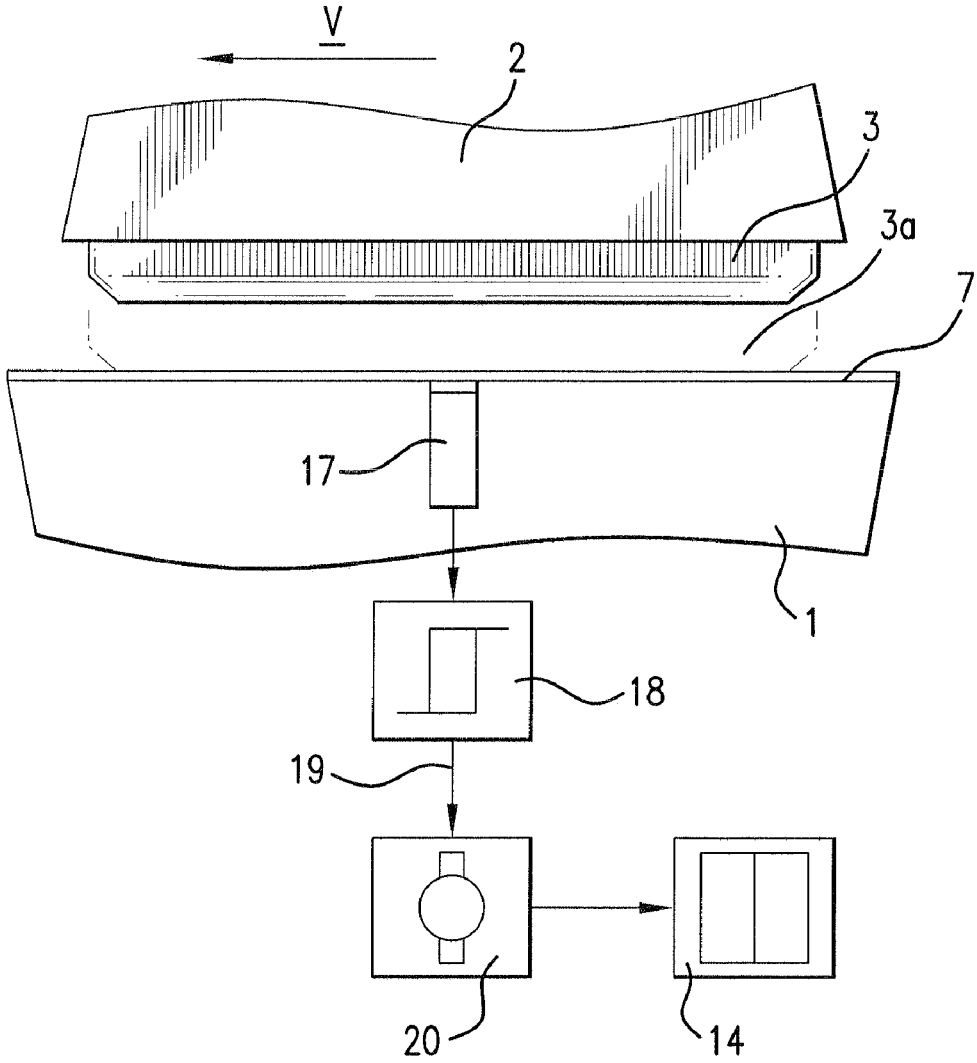
FIG. 1 shows a roughly schematic representation of a device according to the invention by taking the example of a magnetic levitation vehicle.
Figure 2:
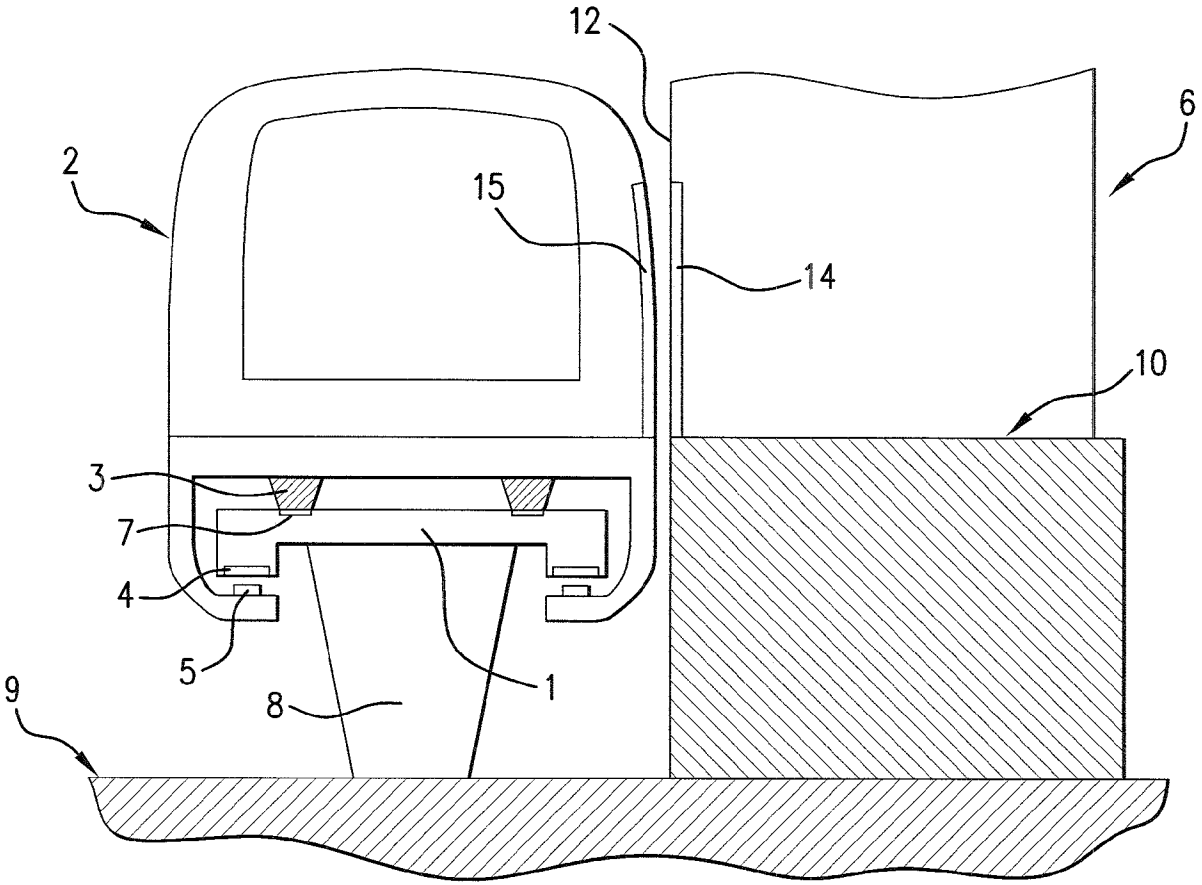
FIG. 2 shows a schematic, partly cut front view of a magnetic levitation vehicle in the area of a railway platform.

FIG. 1 and FIG. 2 schematically show a guideway 1 of a track-bound magnetic levitation railway. At one underside, a vehicle 2 of the magnetic levitation railway is provided with gliding skids 3 arranged one behind the other in the direction of travel (arrow v in FIG. 1). The vehicle 2 is driven in a well-known manner, e.g. by a long-stator linear motor which comprises a long-stator 4 extending at the guideway 1 in the direction of travel, alternating current windings laid into said long-stator and several carrying magnets 5 arranged one behind the other in the direction of travel at the vehicle 2. The vehicle 2 is driven on the one hand by feeding an electrical three-phase current of a different amplitude and frequency into the alternating current windings and on the other hand by feeding an electrical direct current to the windings of the carrying magnets 5. Thereby, the carrying magnets 5 lift the vehicle 2 by a defined amount from the guideway 1 in order to establish the characteristic suspended state, and at the same time provide the excitation field of the long-stator linear motor so that the vehicle 2 is moved on with the frequency of the electrical current fed into the long-stator windings. If the vehicle 2 is brought to a standstill to allow passengers to enter and leave the vehicle in a railway station (FIG. 2) or the like, the carrying magnets 5 are de-energized simultaneously, whereby the vehicle 2 is again lowered onto the guideway 1. In general this is accomplished by setting-down the gliding skids 3 onto gliding strips 7 which are mounted on the upper side of the guideway 1.

Magnetic levitation railways of this kind are generally known (e.g. from DE 33 03 961 C2, DE 38 07 919 C2, DE 39 17 058 C1), and therefore, they need not be explained in greater detail to those skilled in the art.

If the guideway 1 according to FIG. 2 is mounted by the aid of beams 8 at a large height above a schematically indicated ground floor 9, a railway platform 10 of a railway station 6 must be arranged at an appropriate height in order to allow for entering and/or leaving the vehicle 2 at a level flush to ground floor. Therefore, the platform edge is barriered (confined) towards the outside over its entire length by a protection wall 12 in order to prevent passengers from falling down from the platform edge as long as there is no vehicle 1 in the railway station 6. In the protection wall 12, however, there are platform doors 14 which are so arranged and configured that they are precisely aligned to the vehicle doors 15, if the vehicle 2, viewed in the direction of travel, takes a precisely prescribed position in relation to the platform 10.

The number of platform doors 14 provided in the protection wall 12 need not match the number of vehicle doors 15. It is only important that the protection wall 12 extends over the entire length of the vehicle 2 or of a train composed of several vehicles of such type. Moreover, the distances between the platform doors 14 are expediently so chosen that at least some of the vehicle doors 15 stand opposite to a platform door 14 when the vehicle 2 takes its preselected nominal position in the central railway station 6. Besides, care shall be taken to ensure that a platform door 14 can only be opened either when a vehicle door 15 stands exactly opposite to it, with the term "exactly" meaning that the two doors 15, 14 are aligned to each other at permissible tolerances of a few centimeters, or when at least a closed part of the outer wall of said vehicle 2 is located in front of the platform door 14, said closed part preventing any passage by passengers even if the platform door 14 is open.

To automatically ensure such conditions, according to the present invention a device is provided that permits opening a platform door 14 only if the vehicle 2 has taken a preselected state. In case of a magnetic levitation vehicle, this means on the one hand that the vehicle 2 must have been set down with the gliding skids 3 onto the gliding strips 7 and is, therefore, in a non-driven status. On the other hand, at least one sensor unit 17 according to FIG. 1 firmly assigned to the relevant platform door 14 must have been caused by a gliding skid 3 to produce a signal "gliding skid 3 set-down". This signal is transmitted only and solely if the gliding skid 3 as indicated on FIG. 1 by a dashed position 3*a* touches the sensor unit 17 or has at least come sufficiently close to it. Accordingly, the sensor unit 17 may comprise, for example, of one or several digitally or analogously working proximity switches which can safely identify the state of the gliding skid 3 and, hence, the state of the vehicle 2 (i.e. lifted or lowered) by way of inductive, capacitive, mechanical or other actually known means.

As shown on FIG. 1, a gliding skid 3 has a length in the direction of travel (arrow v) which for example amounts to approximately 400 mm, thus being substantially larger than the length or width of usual proximity switches. Therefore, the length of the gliding skid 3 in relation to the extension of the sensor unit 17 measured in the same direction determines the range of tolerance within which the gliding skid 3 as per FIG. 1 can be moved to the right or to the left without leaving the range of action of sensor unit 17 when being set-down onto the gliding strip 7 and thus causing a signal "gliding skid 3 not set-down".

At the same time, in usual magnetic levitation railways, the gliding skids 3 represent a measure for the position of the vehicle doors 15. Viewed in the longitudinal direction of vehicle 2, the vehicle doors 15 and the gliding skids 3 follow each other with a certain matrix (raster) distance, which for example amounts to 3 m for the gliding skids 3 and to 12 m for the vehicle doors 15. The distance of the platform doors 14 is expediently rated at the same size, i.e. 12 m. According to the present invention, this arrangement is utilized to position the sensor unit 17 of a platform door 14 in the closest possible vicinity thereof and particularly to position it in the guideway 1 in such a manner that the platform door 14 either stands opposite to any of the vehicle doors 15 or to the outer wall of the vehicle 2 in case that one of the gliding skids 3 is located within the range of action of the sensor unit 17. Furthermore, the arrangement has been chosen so as to ensure that a platform door 14 assigned to this sensor unit 17 can never stand opposite to an empty guideway section, no matter by which gliding skid 3 of said vehicle 2 the signal "gliding skid 3 set-down" has been triggered at any sensor unit 17. This does not pose any problem in a middle area of the vehicle 2. At the ends of the platform 10, however, care shall be taken to ensure that even the actuation of a sensor unit 17 located there by any gliding skid 3 of the vehicle 2 cannot lead to an undesired opening status of the assigned platform door 14.

According to FIG. 1, the sensor unit is connected to an evaluating device 18 which depending on the type and number of the utilized sensors preferably issues a static release signal at an output 19. The output 19 is connected with a door control 20 which for example comprises a drive motor for opening and/or closing the assigned platform door 14. This door control 20 is so configured that an opening of the relevant platform door 14 is only possible if the release signal is transmitted through the line 19. Accordingly, it does not matter whether the release signal immediately executes or initiates an automatic opening of the platform door 14, for example by switching-on the drive motor for the platform door 14, or whether by means of the release signal only an unlocking of a lock is carried out, which will then allow for a manual opening or, in response to a manually effected pressing of a pushbutton, an automatic opening of the platform door 14.

If the release signal is not established at line 19, the vehicle door 15 can by no means be opened, because either the drive motor cannot be switched-on or a locking mechanism has snapped into place. However, if the release signal vanishes after it has initially enabled and caused an opening of the vehicle door 15, because for example the vehicle 2 is again listed into the suspended state to allow the vehicle to carry-on its journey, then the consequence automatically effected through the door control 20 is that a forced drive not shown here will prompt a closing of the platform door and re-establish an existing locking, if any.

In case of a magnetic levitation vehicle 2, the sensor units 17, according to FIG. 1, are preferably arranged in the relevant gliding strip 7 in such a countersunk arrangement that their measuring surfaces are arranged flush with the gliding strip 7 or a little under them.

Damage by the gliding skids 3 and a dismantling and/or destruction by non-authorized persons are thereby made more difficult and prevented, respectively.

If required, the acquisition (detection) of the status of the vehicle as described hereinabove can be performed with as many sensor units 17 as there are gliding skids 3 in order to obtain high redundancy. In this case, all sensor units 17 are expediently connected to a common evaluating device 18 which issues a release signal for all platform doors 14 if and when the vehicle 2 is precisely located in a preselected nominal position.

Within the scope of the present invention, it is not regarded as a disadvantage if platform doors 14 are opened that stand opposite to a vehicle section that has no vehicle door 15, because in this case a transfer of persons between vehicle 2 and platform 10 is not possible. Besides, the vehicle doors 15 are only released by the operation center for opening if the vehicle 2 takes the preselected position within the central railway station 6 in which position all vehicle doors 15 based upon their design and construction stand opposite to a platform door 14 so that the described control cannot cause any damage or injuries. Moreover, the control according to the present invention yields the advantage of being independent of a central master control station as well as the advantage of safe functions despite simple means.

The invention is not limited to the described embodiment that can be diversified in a plurality of ways. What has been described by the example of a magnetic levitation vehicle can readily be transferred to other vehicles, too. If there is no levitating function incorporated in these vehicles, the sensor units 17 are arranged in a different manner and so brought into cooperation with suitable vehicle components that no opened platform door can cause serious injuries to the passengers. Furthermore it would be possible for increasing the safety of the detection of the sensor signals to provide each sensor unit 17 with several equivalent sensors or with sensors working on the basis of different processes and granting a release only if the majority of sensors issues a signal "gliding skid 3 set-down". For example, each sensor unit 17 could be provided with three sensors or more, and the signal for release could be generated only if at least two of these sensors issue the signal "gliding skid 3 set-down". Thereby it would also be possible to prevent any faults that are caused by damages to the gliding skids 3 and particularly by the fact that due to a defect the skids 3 do not and/or not any longer lead to a response of an assigned sensor unit. Moreover, the term "release" is meant to include and cover all passive and active types of a door actuation and/or door locking. Furthermore, the evaluating device 18 can additionally be connected to status sensors by means of which it is examined whether the vehicle 2 is really on standstill so that the signal for release is only issued if the standstill of the vehicle 2 has surely occurred. Finally it is self-explanatory that the different features can also be applied in combinations other than those described and shown hereinabove.

The invention claimed is:

1. A device for controlling a platform door (14) located at a guideway (1) of a magnetic levitation vehicle, said vehicle being provided with at least one gliding skid (3) and said guideway (1) being provided with a gliding strip (7) onto which said at least one gliding skid (3) is set-down during a standstill of the vehicle, the device comprising at least one sensor unit (17) for detecting a preselected state of the vehicle (2) by responding to a preselected distance of the gliding skid (3) from the gliding strip (7), being mounted at the guideway (1), and an evaluating device (18) connected to the sensor unit (17) and permitting the platform door (14) to open only when said at least one gliding skid (3) has at least come sufficiently close to said sensor unit (7).

2. A device according to claim 1, characterized in that the sensor unit (17) comprises at least one proximity switch co-operating with at least one assigned vehicle component (3).

3. A device according to claim 1, characterized in that the sensor unit (17) comprises at least one sensor built-in into said guideway (1).

4. A device according to claim 1, characterized in that the evaluating device (18) issues a static release signal as long as the vehicle (2) is in the preselected state.

5. A device according to claim 1, characterized in that the evaluating device (18) is so configured that it releases or causes an automatic opening of the platform door (14) when the preselected state has been established.

6. A device according to claim 1, characterized in that the sensor unit (17) comprises at least three sensors and that the evaluating device (18) permits the platform door (14) to open only when at least two sensors indicate the preselected state of the vehicle (2).

7. A device according to claim 1, characterized in that the sensor unit (17) responds to a preselected distance of the gliding skid (3) from the gliding strip (7).

8. A device according to claim 7, characterized in that the sensor unit (17) is built-in into the gliding strip (7).

9. A device according to claim 1, characterized in that several platform doors (14) are arranged at the guideway (1) and that a sensor unit (14) each with a connected evaluating device (18) is assigned to each platform door (14).

10. A device according to claim 1 characterized in that it comprises means for an automatic closure of the platform door(s) (14) or for keeping them closed in case that a release signal once appeared will vanish again or if no release signal has been issued.

11. A device according to claim 1, characterized in that it comprises a sensor unit (17) each for each gliding skid (3), that all sensor units (17) are connected to a common evaluating device (18) and that the latter issues a release signal only when and as long as the preselected state of the vehicle (2) is simultaneously detected by all sensor units (17).

12. A device for controlling a platform door (14) located at a guideway (1) of a magnetic levitation vehicle, said vehicle having vehicle doors (15) and being provided with at least one gliding skid (3) and said guideway (1) being provided with a gliding strip (7) onto which said at least one gliding skid (3) is set-down during a standstill of the vehicle, the device comprising at least one sensor unit (17) for detecting a preselected state of the vehicle (2) by responding to a preselected distance of the gliding skid (3) from the gliding strip (7), being mounted at the guideway (1), and an evaluating device (18) connected to the sensor unit (17) and permitting the platform door (14) to open only when said at least one gliding skid (3) has at least come sufficiently close to said sensor unit (7) and a release of a door opening of said door is dependent only on a position of the vehicle (2) in relation to the platform door (14) in which the vehicle has set down with the gliding skid (3) onto the guiding strip (7) and therefore is in a non-driven status.

* * * * *